United States Patent [19]

Jackson

[11] Patent Number: 4,897,068

[45] Date of Patent: Jan. 30, 1990

[54] PROPELLER EQUIPPED APPARATUS FOR EXHAUST PIPES

[76] Inventor: Joseph S. Jackson, 3832 West 64th St., Inglewood, Calif. 90302

[21] Appl. No.: 303,194

[22] Filed: Jan. 30, 1989

[51] Int. Cl.[4] ..... A63H 33/40

[52] U.S. Cl. ..... 446/217; 180/309

[58] Field of Search ..... 446/217, 218, 210, 211, 446/176; 40/440, 479; 116/138, 58 R; 73/861.33, 861.75, 861.79, 861.89; 180/309

[56] References Cited

U.S. PATENT DOCUMENTS

| | | | |
|---|---|---|---|
| D. 268,053 | 2/1983 | Kozlowski . | |
| 896,606 | 8/1908 | Wright | 116/138 |
| 1,019,571 | 3/1912 | West | 116/138 |
| 2,788,612 | 4/1957 | Sametz . | |
| 4,031,656 | 6/1977 | Kupperman et al. . | |
| 4,649,756 | 3/1987 | Feller | 73/861.89 X |

*Primary Examiner*—Mickey Yu

*Attorney, Agent, or Firm*—Henderson & Sturm

[57] ABSTRACT

A propeller equipped apparatus (10) for use in combination with the exhaust tailpipe (110) of a vehicle (100) wherein the apparatus (10) includes a mounting unit (11) including a housing member (13) having a stem element (16) which terminates in a shaft member (20); and, a propeller unit (12) including a propeller assembly (30) mounted on the shaft member (20) wherein the axis of rotation of the propeller assembly (30) generally coincides with the longitudinal axis of the exhaust tailpipe (110).

6 Claims, 1 Drawing Sheet

PROPELLER EQUIPPED APPARATUS FOR EXHAUST PIPES

TECHNICAL FIELD

This invention relates in general to moving air current driven propeller amusement devices.

BACKGROUND OF THE INVENTION

As can be seen by reference to the following U.S. Pat. Nos. 2,788,612; Des. 268,053; and 4,031,656 the prior art is replete with myriad and diverse propeller equipped amusement devices.

While all of the aforementioned prior art constructions are considered to be adequate for the basic purpose and function for which they were specifically designed, they also are fairly limited in their proposed usage, in that they either require ambient air currents or the relative movement between the article that they are mounted upon, and the ambient air currents for the propulsion forces required to impart rotary movement to the impeller surfaces of the propeller member.

While most people are familiar with propeller equipped beanies, bicycle handle bar propeller equipped attachments, and propeller equipped wind vanes; to date no one has developed a propeller driven attachment for the outlet of the exhaust pipe of an internal combustion vehicle; which is the express purpose and intent of the subject matter of this invention.

BRIEF SUMMARY OF THE INVENTION

Briefly stated, the present invention involves a propeller equipped apparatus that is adapted to be mounted on the outboard end of a vehicle exhaust pipe, wherein the normal exhaust gases produced by an idling combustion engine will be sufficient to rotate the propeller while the vehicle is stopped with the engine operating; and, wherein the revolutions per minute r.p.m. of the propeller blades will increase in proportion to the combined increase of the exhaust gas flow and the speed of the vehicle relative to the ambient air currents.

The propeller equipped apparatus that forms the basis of the present invention comprises in general: a mounting unit that is adapted to be releasably secured and disposed in a surrounding relationship with respect to a vehicle exhaust tailpipe; and, a propeller unit having a propeller member which is operatively associated with the mounting unit and the exhaust tailpipe; such that the propeller member is rotatably disposed generally along the longitudinal axis of both the mounting unit and the outlet of the exhaust tailpipe.

By virtue of the foregoing relationship between the axis of rotation of the propeller member and the longitudinal axis of the exhaust tailpipe, the exhaust gases emanating from the tailpipe will be uniformly dispersed into the atmosphere; and, in some instances the speed of the vehicle will be sufficient to create a negative presence at the outlet of the exhaust tailpipe to assist in the evacuation of the exhaust gases therefrom.

BRIEF DESCRIPTION OF THE DRAWINGS

These and other objects, advantages, and novel features of the invention will become apparent from the detailed description of the best mode for carrying out the preferred embodiment of the invention which follows, particularly when considered in conjunction with the accompanying drawings, wherein.

BEST MODE FOR CARRYING OUT THE INVENTION

Figure 1:
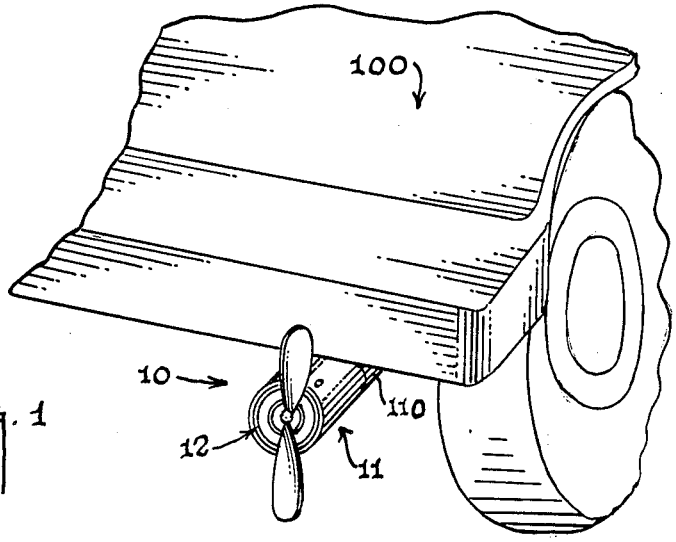
FIG. 1 is a perspective view of the propeller equipped apparatus in use in its intended environment.

As can be seen by reference to the drawings and in particular to FIG. 1, the propeller equipped apparatus that forms the basis of the present invention is designated generally by the reference numeral (10). As mentioned earlier on in the specification, the apparatus (10) was specifically designed to be used in combination with the exhaust tailpipe (110) of an internal combustion powered vehicle (100). The propeller equipped apparatus (10) comprises in general: a mounting unit (11) and a propeller unit (12). These units will now be described in seriatim fashion.

Figure 2:
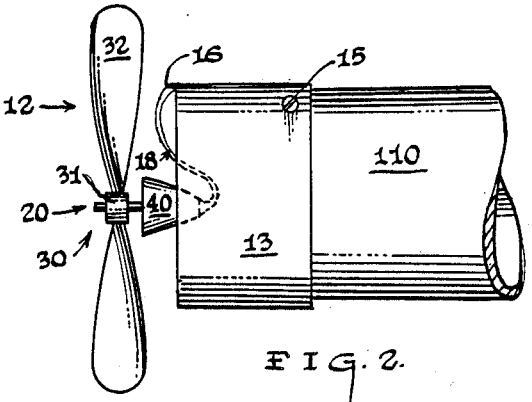
FIG. 2 is an enlarged detail view of the apparatus mounted on an exhaust tailpipe.
Figure 3:
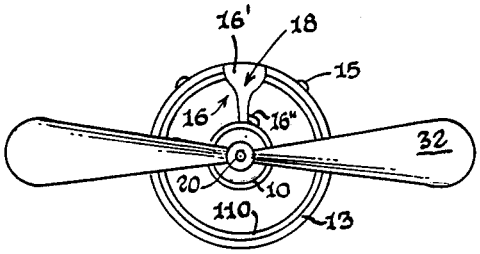
FIG. 3 is an isolated exploded perspective view of the apparatus.

As shown in FIGS. 2 and 3, the mounting unit (11) comprises a generally cylindrical collar member (13) having a plurality of discrete apertures (14) disposed at spaced locations around its periphery; wherein, the inner periphery of the collar member (13) is dimensioned to slidingly engage the exterior periphery of the exhaust tailpipe (110); and, wherein the discrete apertures (14) are dimensioned to receive conventional securing means (15), which are adapted to frictionally secure the collar member (13) to the exhaust tailpipe (110) in a well recognized fashion.

In addition, the outboard end of the collar member (13) is provided with at least one armature shaft member (18) comprising an initially outwardly and downwardly depending generally S-shaped tapered stem element (16), which has an upper portion (16') which eventually projects inwardly within the confines of the collar member (13) towards the longitudinal axis of the collar member (13); whereupon, the bottom portion (16'') of the generally S-shaped stem element (16) then projects outwardly with respect to the outboard periphery of the collar member (13), and is generally disposed in alignment with the longitudinal axis of the collar member (13).

Figure 4:
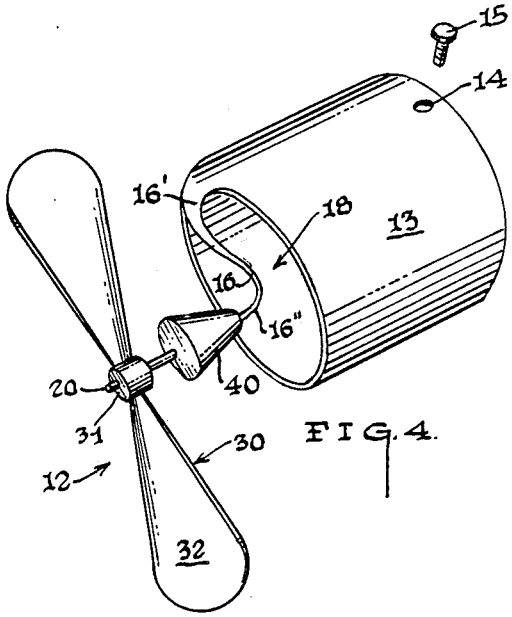
FIG. 4 is a front elevation view of the apparatus.

Referring now to FIGS. 2 thru 4, it can be seen that the end of the bottom portion (16'') of the stem element (16) terminates in a tubular shaft member (20) whose purpose and function will be described in greater detail presently. The propeller unit (12) comprises a propeller assembly designated generally by the reference numeral (30); wherein, the propeller assembly (30) comprises a hub member (31) having a plurality of propeller blade elements (32) radially disposed thereon. The hub member (31) in turn is rotatably disposed in a well recognized manner on the free end of the tubular shaft member (20); and, a generally conical airfoil spoiler member (40) is operatively connected to the tubular shaft member (20) intermediate the location of the propeller assembly (30) and the inboard end of the bottom portion (16'') of the housing stem element (16).

At this juncture it should be appreciated that the propeller equipped apparatus (10) of this invention may be quickly and easily installed on the outlet end of a vehicle exhaust tailpipe (110); wherein, the exhaust gases emanating from the tailpipe (110) will impart a rotary movement to the propeller assembly (30) after the exhaust gases have passed over the airfoil member (40).

This rotary movement of the propeller assembly (30) will be maintained even while the vehicle (100) is standing still, and the r.p.m. of the propeller blade elements (32) will increase in proportion to the speed of the vehicle relative to the ambient air currents.

Having thereby described the subject matter of this invention it should be apparent that many substitutions, modifications and variations of the invention are possible in light of the above teachings. It is therefore to be understood that the invention as taught and described herein is only to be limited to the extent of the breadth and scope of the appended claims.

I claim:

1. A propeller equipped apparatus in combination with the outlet end of the exhaust tailpipe of a vehicle wherein the propeller equipped apparatus comprises:

a mounting assembly designed to engage and be operatively secured in a surrounding relationship relative to the external periphery of said outlet end of the exhaust tailpipe; wherein the mounting assembly is further provided with an outwardly disposed armature shaft member having an inboard end and an outboard end;

a propeller assembly comprising a propeller unit that is operatively connected to said armature shaft member; whereby, the propeller assembly is readily visible on the outside of the mounting assembly on the outlet end of the exhaust tailpipe.

2. The combination as in claim 1 wherein said armature shaft member includes a portion that is generally disposed in alignment with the longitudinal axis of said exhaust tailpipe.

3. The combination as in claim 2 wherein said propeller unit is rotatably disposed on the outboard end of said armature shaft member.

4. The combination as in claim 3 wherein said propeller assembly further comprises an airfoil spoiler member.

5. The combination as in claim 4 wherein said airfoil spoiler member is disposed on the armature shaft member intermediate the location of said propeller assembly and the inboard end of armature.

6. The combination as in claim 5 wherein said airfoil spoiler member has a generally conical configuration.

* * * * *